US005115824A

United States Patent [19]

Marshall

[11] Patent Number: 5,115,824

[45] Date of Patent: May 26, 1992

[54] FILTRATION OF TOBACCO USING MOISTURE FREE, ELECTRICALLY NEUTRAL HYDROPHOBIC PARTICLES

[75] Inventor: Robert A. Marshall, Cambridge, Mass.

[73] Assignee: Center For Applied Research, Inc., Cambridge, Mass.

[21] Appl. No.: 588,803

[22] Filed: Sep. 27, 1990

[51] Int. Cl.[5] ..... A24D 3/06

[52] U.S. Cl. ..... 131/342; 131/331; 131/344

[58] Field of Search ..... 131/342, 344, 331

[56] References Cited

U.S. PATENT DOCUMENTS

| | | | |
|---|---|---|---|
| 3,079,926 | 3/1963 | Litchfield et al. | 131/331 |
| 3,662,765 | 5/1972 | Clark . | |
| 3,939,848 | 2/1976 | LeRoy | 131/331 |
| 4,037,607 | 7/1977 | Grossman | 131/335 |
| 4,059,119 | 11/1977 | Grossman | 131/335 |
| 4,076,031 | 2/1978 | Grossman | 131/335 |
| 4,084,596 | 4/1978 | Grossman | 131/352 |
| 4,146,040 | 3/1979 | Cohn | 131/249 |
| 4,149,549 | 4/1979 | Grossman | 131/342 |
| 4,396,026 | 8/1983 | Grossman . | |
| 4,637,408 | 1/1987 | Rainer et al. | 131/334 |
| 4,744,374 | 5/1988 | Deffeves et al. . | |
| 7,753,250 | 6/1988 | Bitter et al. . | |

FOREIGN PATENT DOCUMENTS

| | | |
|---|---|---|
| 1517272 | 1/1970 | Fed. Rep. of Germany . |
| 3447445 | 8/1986 | Fed. Rep. of Germany . |

*Primary Examiner*—V. Millin
*Assistant Examiner*—Lynne Reichard
*Attorney, Agent, or Firm*—Cesari and McKenna

[57] ABSTRACT

Hydrophobic particles containing polar groups on their surfaces are incorporated into a tobacco smoking article to remove deleterious chemical compounds, both polar and non-polar, from the tobacco smoke.

24 Claims, 3 Drawing Sheets

FILTRATION OF TOBACCO USING MOISTURE FREE, ELECTRICALLY NEUTRAL HYDROPHOBIC PARTICLES

BACKGROUND OF THE INVENTION

A. Field of the Invention

This invention relates generally to filters for tobacco smoking devices, and particularly to the use of filter materials that are capable of trapping and removing deleterious chemical compounds, both polar and non-polar, from tobacco smoke.

B. Description of the Related Art

Tobacco smoke contains thousands of chemical compounds of various kinds from the combustion of tobacco. It is well known that many of these compounds are physiologically detrimental to habitual smokers. Recent studies further indicate that tobacco smoke can also harm nonsmokers. Thus, concern about the health hazards caused by tobacco smoke has grown steadily, prompting research for better ways of reducing the harmful effects of tobacco combustion.

Conventional methods for removing or reducing deleterious chemical components from the tobacco smoke include use of filters consisting of cellulose acetate fiber, activated carbon, or the like. These filters reduce the concentration of these harmful components in tobacco smoke to a certain extent, but their efficiency is still unsatisfactory. For example, these filters do not selectively adsorb ionic or polar compounds from the tobacco smoke, many of which are believed to be among the most highly deleterious to the body.

Two recent U.S. patents disclose use of silaceous materials to retain chemical compounds in the tobacco smoke. In U.S. Pat. No. 4,637,408, a multi-component filter, which is capable of removing nitric oxide from the smoke, contains a hydrophilic fumed colloidal silica. U.S. Pat. No. 4,744,374, on the other hand, describes a new family of compounds, namely, hydrophobic microporous crystalline tectosilicates. It is claimed that these compounds, which are free of hydroxyl groups, can be used in a cigarette or pipe filter to absorb carbon monoxide.

DESCRIPTION OF THE INVENTION

Objects of the Invention

Accordingly, the present invention aims to provide a device or method for removing numerous deleterious compounds in the tobacco smoke from a cigarette, cigar, or pipe.

A further object of the invention is to provide such a device or method which does not significantly affect the resistance-to-draw of a cigarette, cigar, or pipe.

Yet another object of the invention is to provide such a device or method which is relatively inexpensive to manufacture or practice.

It is still another object of the present invention to provide such a device or method which can be readily adapted to a conventional cigarette or cigar.

Other objects will, in part, be obvious and will, in part, appear below.

The invention accordingly comprises the features of construction, combination of elements and arrangement of parts which will be exemplified in the following detailed description, and the scope of the invention will be indicated in the claims.

SUMMARY OF THE INVENTION

Briefly and generally, the present invention employs, as the filter material, hydrophobic particles that possess externally disposed polar groups to trap and remove deleterious substances in the tobacco smoke. The hydrophobicity of the particles derives from the presence of low alkyl groups on their surfaces. The polar groups may be hydroxyl species, thiol species, or the like.

Preferably, such particles are disposed in a filter unit through which the tobacco smoke passes before it is inhaled by the smoker. The filter particles of the present invention are capable of trapping both polar and non-polar species. Their hydrophobic nature facilitates retention of non-polar compounds in the tobacco smoke. The adsorption of polar components, on the other hand, can be attributed to the existence of polar groups on the particle surfaces.

To increase the capacity of the hydrophobic particles to adsorb components in the tobacco smoke, it is desirable that they be at least somewhat movable, and preferably gravity-packed. To achieve this, a filter unit is partially filled with relatively light particles, thereby permitting the particles to move around in the free space therein during smoking. The filter's adsorption capacity can also be increased by utilizing particles which have a relatively high surface area.

The above-described filter material can be used singly or in combination with one or more filter devices which are well-known in the art. Furthermore, it can be dispersed within the matrix of conventional filter material, such as cellulose, to enhance the performance thereof. It can also be applied to the tobacco-wrapping paper of a cigarette to filter the side stream smoke.

In one embodiment of the present invention, fumed hydrophobic colloidal silica, which possesses both methyl and hydroxyl groups on its surface, is used as the filter material. Quantitative analyses of the tobacco smoke before and after filtration clearly demonstrate the utility of the present invention to entrain particulate matter generated by tobacco combustion. Further preliminary analysis suggests that colloidal silica, as embodied in the present invention, removes both polar compounds and non-polar compounds.

BRIEF DESCRIPTION OF THE DRAWINGS

The above and further advantages of the invention may be better understood by referring to the following description in conjunction with the accompanying drawings, in which.

DETAILED DESCRIPTION OF ILLUSTRATIVE EMBODIMENTS

Figure 1A:
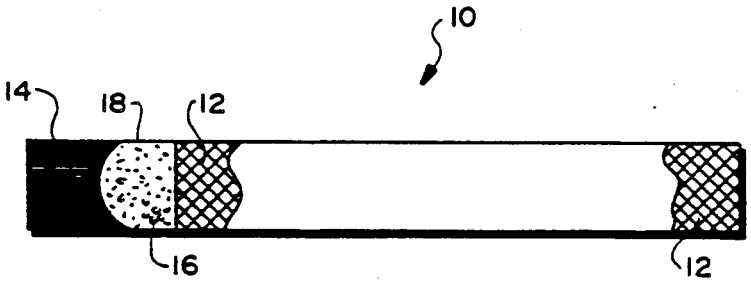
FIG. 1A is an elevational view, with a part broken away, of a cigarette which represents one embodiment of the present invention.
Figure 1B:
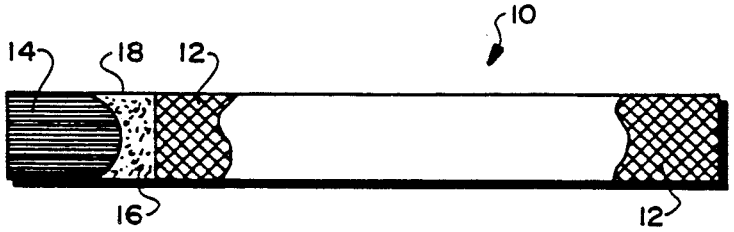
FIG. 1B is an elevational view, with a part broken away, of a cigarette which represents another embodiment of the present invention.

Refer first to FIGS. 1A and 1B, each of which depicts a cigarette, designated at numeral 10, incorporating several preferred features of the present invention. In general, the cigarette 10 is composed of three parts: a body of divided tobacco leaves 12, a conventional cigarette filter unit 14, and a filter material 16 placed between the tobacco body 12 and the conventional filter unit 14. The filter unit 14 may contain cellulose acetate fibers, activated carbon, or a combination thereof. The filter material 16, on the other hand, is a powdery substance consisting of hydrophobic particles which possess exposed polar groups.

The filter material 16, i.e., the hydrophobic particles, is capable of binding, and thus removing from the smoke stream, various harmful substances generated by tobacco combustion. This occurs because the hydrophobic surfaces of the particles 16 can adsorb non-polar compounds and the exposed polar groups, on the other hand, tend to adsorb polar compounds.

Preferably, the adsorption capacity of the filter material 16 is not affected by the heat produced during smoking. Also, it is important that the hydrophobic particles which constitute the filter material 16 be of such sizes that they cannot pass through the filter unit 14 and enter the mouth or lungs of the smoker. The amount of filter material 16 required depends on at least three factors and can be readily determined by one skilled in the art. The factors to be considered include the size of the tobacco body 12, the adsorption capacity of the filter material 16, and the amount of substances desired to be removed.

In one embodiment of the invention, the hydrophobic particles are CABOSIL TS-720 fumed silica supplied by Cabot Corporation, CABOSIL Division, Tuscola, Ill. CABOSIL TS-720 hydrophobic fumed silica (referred to below as "CABOSIL") is prepared by treating a high-purity fumed silica (99.8% $SiO_2$) with polydimethylsiloxane, a polymeric organosilicon compound. More specifically, during manufacture, the surface of the fumed silica is completely coated with the organosilicon compound. This changes the nature of the silica surface from a hydrophilic to an extremely hydrophobic character.

The infrared spectrum of CABOSIL shows the presence of surface methyl groups due to the coating and also the continued presence of some surface hydroxyl groups. The presence of the methyl groups on the surface of CABOSIL greatly increases its hydrophobicity.

Electron micrographs of CABOSIL show that the material consists of the fused branched-chain aggregates of the primary particles, typical of an uncoated fumed silica.

Other important properties of CABOSIL are set forth below:

| | |
|---|---|
| Appearance | Fluffy white powder |
| Surface Area ($m^2/g$) | 100 +/− 20 |
| Carbon Content (wt. %) | greater than 4.5 |
| Moisture Content (wt. %) | smaller than 0.5 |
| Ignition Loss (wt. %) | smaller than 7.0 |
| Specific Gravity | 1.8 |
| Bulk Density (lbs./cu. ft.) | 2 to 3 |

Contemplated equivalents of CABOSIL are hydrophobic particles which have similar physical properties in size, specific gravity, surface area, and also possess polar groups on their surfaces. The polar group may be a thiol species, an amino species, or the like. The hydrophobicity of such particles, on the other hand, can be due to other non-polar moieties (e.g., low alkyl groups other than methyl species) so long as they do not adversely affect accessibility of smoke components to the polar groups.

Referring back to FIGS. 1A and 1B, it is preferable that the filter material 16 be placed in a curved well 18 (concave well in FIG. 1A and convex well in FIG. 1B) which is confined by one end of the tobacco body 12, an internal end of the filter unit 14, and the paper wrapping the tobacco body 12 and the filter unit 14. It is also desirable that the well 18 be loosely gravity-packed with the filter material 16. As will be shown below, the resistance to draw for a cigarette possessing both of these features is essentially identical to that of a standard cigarette.

While the cigarettes shown in FIGS. 1A and 1B can be manufactured following the conventional procedure for cigarette production, they can also be prepared from standard cigarette equipped with a filter.

By way of example, one can first use a sharp instrument, such as a knife, to separate the filter unit 14 and the tobacco body 12 of a standard cigarette. The exposed end of the filter unit 14 is then compacted into a concave or convex well 18 by means of a solid rod with a round end or the like. After packing a pre-determined amount of the filter material 16, e.g., CABOSIL, in the concave or convex well 18, the cigarette is re-formed by joining, using suitable means (such as paper and gum arabic), the tobacco body 12 and the compacted filter unit 14 which now contains the filter material 16.

The foregoing description has been limited to two specific embodiments of this invention. It will be apparent, however, that variations and modifications may be made to the invention, with the attainment of some or all of the advantages of the invention.

Thus, even though the embodiments disclosed above are cigarettes comprising CABOSIL or the like, other tobacco smoking articles such as cigars or pipes may also be modified to contain such filter material.

Also, while it is preferred that the filter material be used in combination with a conventional filter unit, it may also be used as the sole filter means in a tobacco smoking article, if desired.

Further, the filter material may be incorporated to a cigarette by means other than that described above. For example, it may be conveniently intermixed with the filter unit of a standard cigarette by injection or otherwise.

Alternatively, one can treat the cigarette paper with CABOSIL to effect trapping of harmful substances in the side stream smoke.

It is, therefore, the object of the appended claims to cover all such variations and modifications as come within the true spirit and scope of the invention.

The practice of the present invention and its advantages will be further demonstrated with reference to the following non-limiting examples. In all these example, a standard smoking machine purchased from Tobacco and Health Research Institute, University of Kentucky, Lexington, Ky. was used.

EXAMPLE I

Standard research filtered cigarettes, 1R4F, manufactured by Tobacco and Health Research Institute, University of Kentucky, Lexington, Ky., and filtered cigarettes of different commercial brands were used to test CABOSIL's capability to remove total particulate matter (TPM).

Figure 2:
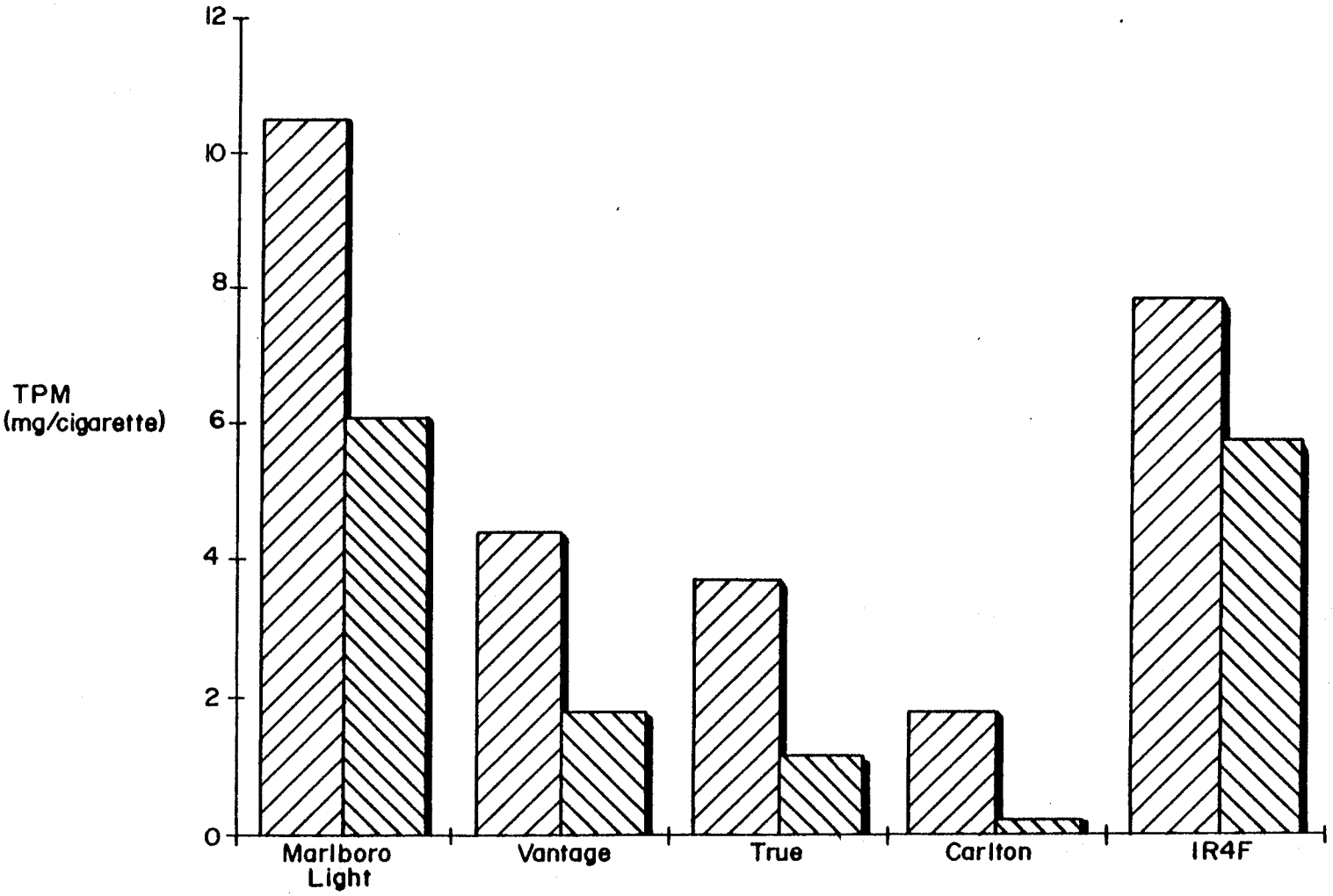
FIG. 2 is a diagram showing the amounts of total particulate matter in the tobacco smoke with and without filtration by means of fumed colloidal silica for cigarettes from various sources; and, FIG. 3 is a diagram showing the resistance to draw of cigarettes from various sources, with and without incorporation of fumed colloidal silica.

2 mg of CABOSIL was first placed between the concave well formed in the filter unit of the cigarettes in the manner described above. The amounts of TPM (mg per cigarette) in the filtered tobacco smoke from both modified and unmodified cigarettes were then measured; TPM constitutes droplets and particles of materials suspended in the tobacco smoke. The results are shown in FIG. 2, where dotted bars indicate TPM levels in the filtered smoke from the modified cigarettes, and solid bars depict similar data for the unmodified cigarettes. This example demonstrates that CABOSIL was capable of trapping TPM in the smoke from all the cigarettes tested. The percentage of TPM removed by CABOSIL varied with the particular source of the cigarettes and was in the range of 30% (1R4F) to 90% (Carlton).

EXAMPLE II

Figure 3:
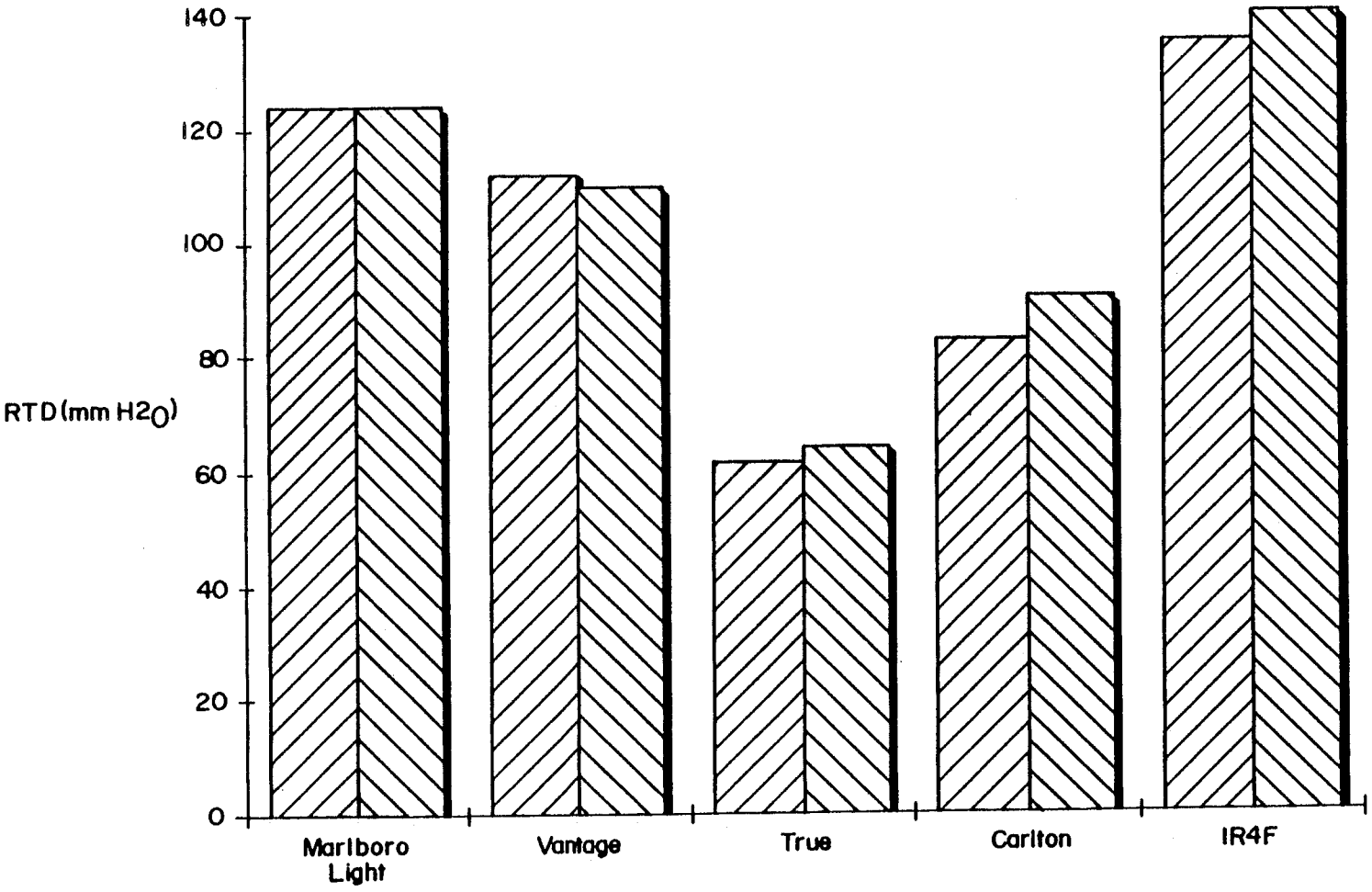

The resistance to draw (RTD, in mm $H_2O$) of the cigarettes prepared in Example II, both with and without modification, were determined. As shown in FIG. 3, where dotted bars indicate the RTD of the modified cigarettes and solid bars indicate the RTD of the unmodified ones, the presence of 2 mg CABOSIL had little effect on the resistance to draw.

The RTD for each cigarette was quantitated by measuring the pressure drop expressed in water-column millimeters between inlet and exit of the measured cigarette when a stream of air flowed through it at 17.5 ml/second (20° C., 760 Torr).

EXAMPLE III

Pre-determined amounts of CABOSIL were deposited into the concave well formed in the filter unit of 1R4F cigarettes in the manner described above. Different amounts of CABOSIL, i.e., 0, 2 and 3 mg, were deposited in each well.

The TPM levels (mg per cigarette) of filtered smoke from all these cigarettes were measured, and the results are shown in Table 1. As expected, the TPM level in the smoke decreased as the amount of CABOSIL was increased. The amount of TPM in the smoke from an unmodified cigarette was 7.8 mg.

EXAMPLE IV 3 mg of CABOSIL was gravity packed to the straight well, the concave well, and the convex well, which were formed respectively in the filter unit of 1R4F cigarettes in the manner described above. The RTD for each cigarette was then measured and the results are shown in Table 2. The RTD for an unmodified 1R4F cigarette was determined to be 150 mm $H_2O$ (the reported value being 138 mm $H_2O$). Thus, modified cigarettes with a concave or convex well gave better results than those with a straight well with respect to RTD.

TABLE 1

| | Amount of CABOSIL | | |
|---|---|---|---|
| | 0 mg | 2 mg | 3 mg |
| TPM (mg/cigarette) | 10.1 | 5.8 | 1.3 |

TABLE 2

| | Shape of Well | | |
|---|---|---|---|
| | Straight | Concave | Convex |
| RTD | 200 | 150 | 150 |

TABLE 2-continued

| | Shape of Well | | |
|---|---|---|---|
| | Straight | Concave | Convex |
| (mm $H_2O$) | | | |

EXAMPLE V

A dispersion was prepared using 4%, by weight, of CABOSIL and 96% isopropyl alcohol. The dispersion was sprayed with an atomizer onto the outer surface of the wrapping paper of twelve 1R4F cigarettes to saturation. The cigarette paper was then dried using a hair dryer. As blank controls, isopropyl alcohol which contained no CABOSIL was applied to the wrapping paper of 1R4F cigarettes in the same manner.

TPM levels (mg per cigarette) in the sidestream smoke collected from the cigarettes thus treated were measured.

The average TPM level was 13.9 mg for the CABOSIL-coated 1R4F cigarettes, and 23.7 mg for those sprayed with the isopropyl alcohol only.

What is claimed is:

1. A tobacco smoking article comprising:

a combustible tobacco body to be burned to produce smoke, and, a filter, placed at one end of said tobacco body, for trapping deleterious substances in the smoke, said filter comprising material that includes generally moisture-free, electrically neutral, hydrophobic particles with polar groups on the surfaces thereof.

2. The smoking article defined in claim 1, wherein the particles are hydrophobic fumed colloidal silica.

3. The smoking article defined in claim 1, wherein the hydrophobicity of the particles is due to presence of non-polar groups on the surfaces thereof.

4. The smoking article defined in claim 3, wherein the non-polar groups include low alkyl species.

5. The smoking article defined in claim 4, wherein the low alkyl species include methyl moieties.

6. The smoking article defined in claim 2, wherein the polar groups include hydroxyl species.

7. The smoking article defined in claim 1, wherein the surface area of the particles is about 100 $m^2/g$.

8. The smoking article defined in claim 1, wherein the specific gravity of the particles is about 1.8.

9. The smoking article defined in claim 1, wherein the bulk density of the particles is from about 2 to about 3 $lbs/ft^3$.

10. The smoking article defined in claim 1, further comprising at least one other filter material in combination therewith to provide a multi-component filter.

11. The smoking article defined in claim 10, wherein said at least one other filter material is disposed between said tobacco body and said filter material.

12. The smoking article defined in claim 11, wherein said filter material is gravity packed in a concave well between said tobacco body and said at least one other filter material.

13. The smoking article defined in claim 11, wherein said filter material is gravity packed in a convex well between said tobacco body and said at least one other filter material.

14. The smoking article defined in claim 1, wherein the smoking article is a cigarette.

15. A filter for tobacco smoke comprising:

an elongated enclosure with porous ends, and, contained therein, generally moisture-free, electrically neutral, hydrophobic particles with polar groups on the surfaces thereof, said particles being present in sufficient quantity that the filter, when attached to a tobacco smoking device at one end, is capable of trapping onto the surfaces of the particles deleterious substances in the tobacco smoke passing through the filter and otherwise escaping at the other end thereof.

16. A cigarette comprising paper wrapping combustible tobacco to be burned to produce smoke and a filter material on or within the paper, said filter material including generally hydrophobic particles with polar groups on the surfaces thereof and being present in sufficient quantity to trap deleterious substances in the smoke.

17. A cigarette comprising paper wrapping combustible tobacco to be burned to produce smoke and a filter material on or within the paper, said filter material including generally moisture-free, electrically neutral, hydrophobic particles with polar groups on the surfaces thereof and being present in sufficient quantity to trap deleterious substances in the smoke.

18. The cigarette defined in claim 17, wherein the particles are applied to the outer surface of the paper.

19. The cigarette defined in claim 18, wherein the particles are hydrophobic fumed colloidal silica.

20. A process for producing the cigarette defined in claim 17, which process comprises the steps of dispersing the particles in a solvent, spraying the solvent which contains the particles onto the paper of a conventional cigarette, and removing the solvent from the paper.

21. The process defined in claim 20, wherein the particles are hydrophobic fumed colloidal silica.

22. The process defined in claim 21, wherein the solvent is isopropyl alcohol.

23. A process for trapping deleterious substances in the tobacco smoke produced from a tobacco smoking article equipped with a filter unit, said process comprising the steps of depositing in the filter unit moisture free, electrically neutral hydrophobic particles with polar groups on the surfaces thereof, and associating the filter unit with the smoking article.

24. The process defined in claim 23, wherein the particles are hydrophobic fumed colloidal silica.

* * * * *